US005192931A

United States Patent [19]

Smith et al.

[11] Patent Number: 5,192,931

[45] Date of Patent: Mar. 9, 1993

[54] DUAL CHANNEL GLASS BREAK DETECTOR

[75] Inventors: Richard A. Smith, Portland; Christopher A. Bernhardt, Tigard, both of Oreg.

[73] Assignee: Sentrol, Inc., Portland, Oreg.

[21] Appl. No.: 835,733

[22] Filed: Feb. 11, 1992

[51] Int. Cl.[5] ..... G08B 13/04

[52] U.S. Cl. ..... 340/550; 340/541; 340/544

[58] Field of Search ..... 340/550, 544, 541

[56] References Cited

U.S. PATENT DOCUMENTS

| | | | |
|---|---|---|---|
| 4,091,660 | 5/1978 | Yanagi | 340/550 |
| 4,668,941 | 5/1987 | Davenport et al. | 340/550 |
| 4,837,558 | 6/1989 | Abel et al. | 340/550 |
| 4,853,677 | 8/1989 | Yarbrough et al. | 340/544 |
| 4,991,145 | 2/1991 | Goldstein et al. | 367/94 |

*Primary Examiner*—Glen R. Swann, III

*Attorney, Agent, or Firm*—Chernoff, Vilhauer, McClung & Stenzel

[57] ABSTRACT

A glass break detector for detecting the breaking of a window or the like includes an acoustic transducer having a wide band frequency response, coupled to a dual channel filter and signal processing circuit. A low frequency channel detects an initial positive compression wave caused by the inward flex of the window and a high frequency channel detects the acoustic spectrum which is characteristic of breaking glass. The two channels are combined in a logic circuit that is timed so that the low frequency positive flex is detected initially with the high frequency component following shortly thereafter. If both timing conditions are fulfilled, an alarm is initiated. Additional circuitry is provided to inhibit the alarm if a negative compression wave is initially detected. The detection sequence is initiated by a loud sound characteristic of breaking glass.

10 Claims, 5 Drawing Sheets

DUAL CHANNEL GLASS BREAK DETECTOR

BACKGROUND OF THE PRESENT INVENTION

The following invention relates to a glass break detector and more particularly to an acoustic sensing device that senses two different frequency characteristics of breaking glass and provides an alarm upon the detection of both occurrences within preselected time frames. The invention results from the discovery that breaking glass produces highly characteristic patterns of acoustic waves, and in particular, produces a characteristic positive low frequency acoustic wave and a high frequency set of acoustic waves that follow the initial low frequency phenomenon.

In the past, glass break detectors have attempted to eliminate the occurrence of false alarms by focusing on high and low frequency characteristics of breaking glass. The U.S. Pat. No. 4,091,660, to Yanagi, detects signals in a frequency range of less than 50,000 cycles and of greater than 100,000 cycles, producing an enabling signal for an alarm when both frequency components are present at the same time. Other devices recognize that different frequency components may be present at different times. In Davenport et al. U.S. Pat. No. 4,668,941, it is presumed that breaking glass produces an initial low frequency thump centered around 350 Hz followed by a high frequency component centered at around 6.5 kHz. The 6.5 kHz signal is indicative of glass that breaks as it falls on the floor and shatters producing a tinkling sound. But as pointed out in Abel et al. U.S. Pat. No. 4,837,558, one can not always presume that glass once broken will produce the tinkling sound, particularly if the glass pane or window is situated above a carpet in an office or residence.

For some time intrusion detectors have made use of the phenomenon that the opening of a door or window produces an infrasonic pressure wave that may be detected by a sensitive microphone or other acoustic transducer having a frequency response in the region of one to five or ten cycles per second. An example of such a device is shown in Yarbrough et al. U.S. Pat. No. 4,853,677. The Yarbrough device also includes a glass break detector circuit that is coupled to the same microphone. Either a high frequency or a low frequency event will trigger an alarm if either produces the appropriate frequency spectrum. Furthermore, it has been recognized that the opening of a door or window produces negative-going air pressure in the first instance and acoustic detectors which are intrusion detectors have been designed to take advantage of this fact. An example is shown in Goldstein et al. U.S. Pat. No. 4,991,145.

The aforementioned glass breakage and intrusion detectors take advantage of some of the characteristics of breaking glass but do not always inhibit false alarms which may be produced by events that have frequency characteristics similar to those produced by breaking glass. Moreover they fail to take into account the fact that, especially in the low frequency region, different types of glass emit different frequency spectra when they break.

SUMMARY OF THE PRESENT INVENTION

The present invention takes advantage of the fact that breaking glass of every known type may be characterized by a positive low frequency acoustic wave produced by an inward flex of the glass as it is being broken from the outside of the room or enclosure to be monitored. This low frequency flex is followed by high frequency acoustic waves having a characteristic frequency spectrum.

According to the invention, an intrusion detector for detecting the breaking of a window, glass pane or the like includes an acoustic transducer such as a microphone and a signal processing circuit responsive to the acoustic transducer for detecting a first low frequency positive acoustic wave generated by an inward flex of the glass and an alarm responsive to the signal processing circuit. The system further includes a high frequency bandpass filter for detecting high frequency acoustic waves characteristic of breaking glass and a coincidence logic circuit that enables the alarm when the low frequency acoustic wave is detected during a predetermined time window that begins with a high frequency event generated by the breaking glass. The alarm may then be triggered by sampling the high frequency output of the transducer at a time after the initial time window. The logic of this system takes advantage of the fact that the requisite high frequency spectrum of acoustic waves will follow the initial positive low frequency wave produced by the inward flex of the glass pane or window.

A circuit may also be provided to inhibit the alarm upon the detection of negative-going low frequency phenomena followed by high frequency sounds that would otherwise partially enable the alarm. The alarm inhibit feature significantly reduces the incidence of false alarms such as those that would be caused by a legitimate opening of a door or window followed by high frequency sounds such as the jangling of keys. The invention also takes advantage of the fact that, regardless of the type of glass, the low frequency component of breaking glass lies in the frequency region between 50 Hz and 100 Hz and that the breaking of glass is always initiated by a positive compression wave. Infrasonic detectors of the prior art frequently operated on the principle that a glass break creates a low frequency sound that resonates the room, coupling it to the outside world through the broken window. The problem, however, is that such low frequency resonance may also occur for a large number of events not associated with breaking glass.

It is a principal object of this invention to provide a glass break detector that accurately discriminates between the sounds of breaking glass and other sounds so as to prevent false alarms.

A further object of this invention is to provide a glass break detector which can detect the breaking o different types of glass.

Yet a further object of this invention is to provide a method for detecting the breaking of a glass panel on the perimeter of an enclosure such as a room by detecting a positive low frequency pressure wave followed by a high frequency sound having a frequency spectrum which is characteristic of breaking glass.

The foregoing and other objectives, features, and advantages of the invention will be more readily understood upon consideration of the following detailed description of the invention, taken in conjunction with the accompanying drawings.

DETAILED DESCRIPTION OF THE INVENTION

Figure 1:
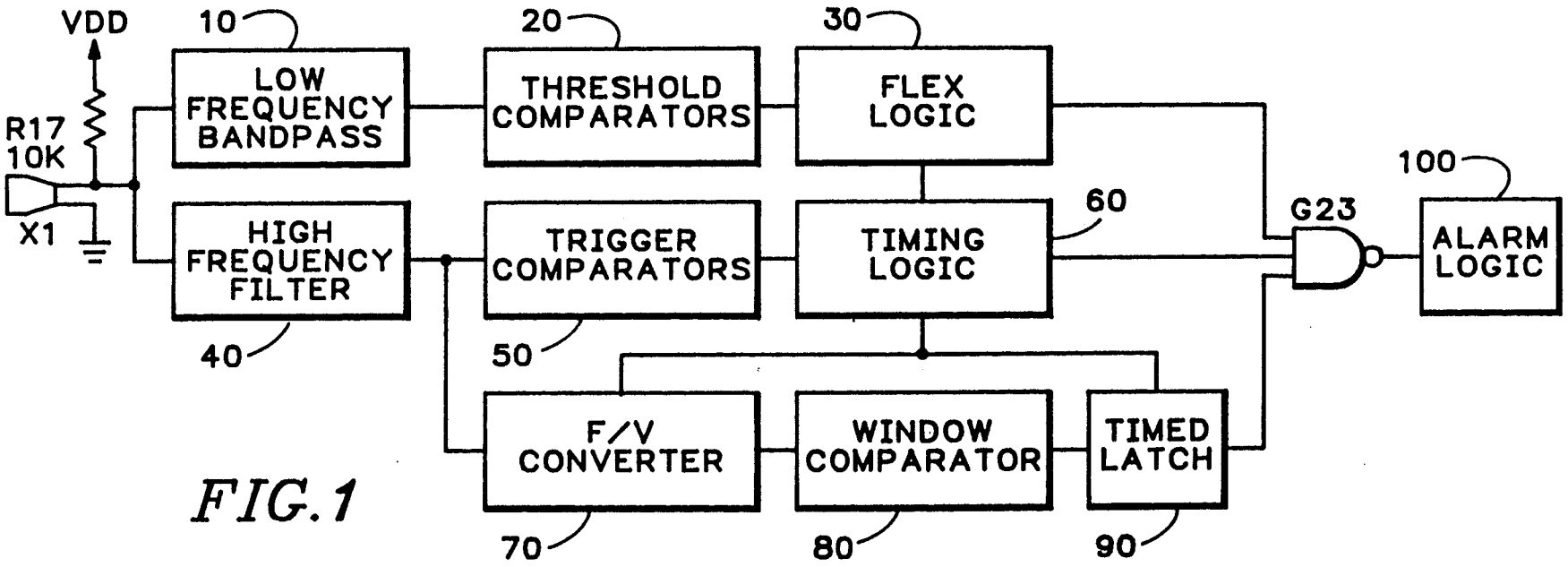
FIG. 1 is a block schematic diagram of the dual channel glass break detector system comprising the invention.

Referring to FIG. 1 a glass break detector includes a microphone X1 coupled to a low frequency band pass filter 10 and a high frequency filter 40 in parallel with a resistor R17 which is coupled to a source of supply voltage Vdd. The low frequency band pass filter 10 is coupled to a set of threshold comparators 20 which define different set points for low frequency components of the signal from the microphone X1. The output of the threshold comparators 20 is coupled to a flex logic circuit 30. The high frequency filter 40 is coupled to trigger comparators 50, which initiate the timing logic for the system and are coupled to timing logic circuits 60. The output of the timing logic circuits is coupled to the flex logic circuit 30 and to a NAND gate G23. The output of the high frequency filter is also coupled to a frequency-to-voltage converter 70 whose output is in turn coupled to a window comparator 80. The output of the window comparator 80 drives a timed latch 90. Both the timed latch 90 and the frequency-to-voltage converter 70 receive timing inputs from the timing logic circuit 60, and the outputs of the flex logic circuit 30 and the timed latch 90 are also inputs to NAND gate G23. The output of NAND gate G23 is connected to an alarm logic circuit 100. The details of the alarm logic circuit 100 are not shown but the circuit is active when the output of NAND gate G23 is low. This will occur only when all three inputs to NAND gate G23 are high, and the alarm logic circuit 100 then develops audible and/or visual alarms. The details of such circuits are well known to those of ordinary skill in the art.

Figure 2A:
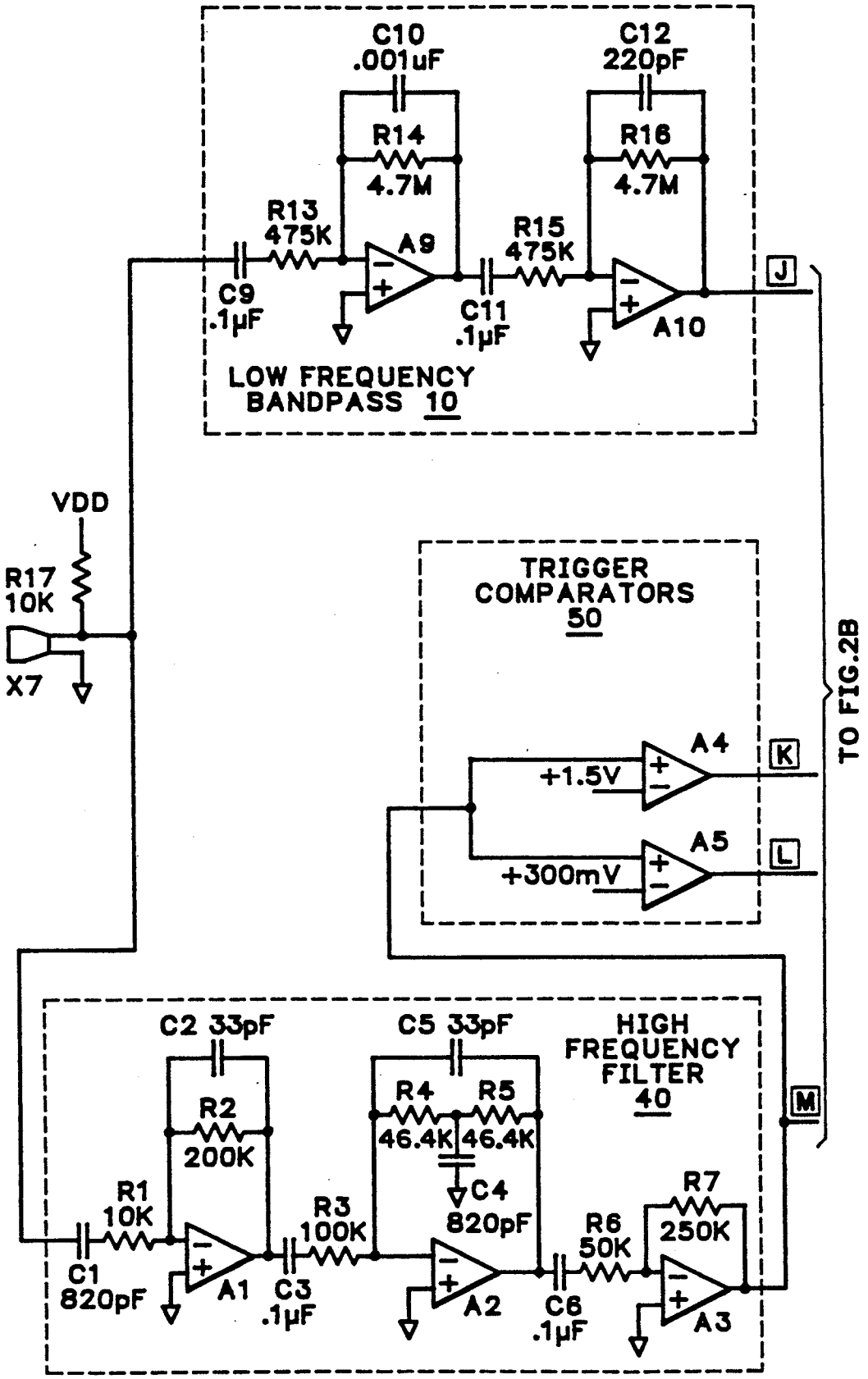
FIG. 2A, 2B and 2C is a detailed schematic diagram based upon the block schematic diagram of FIG. 1.
Figure 2B:
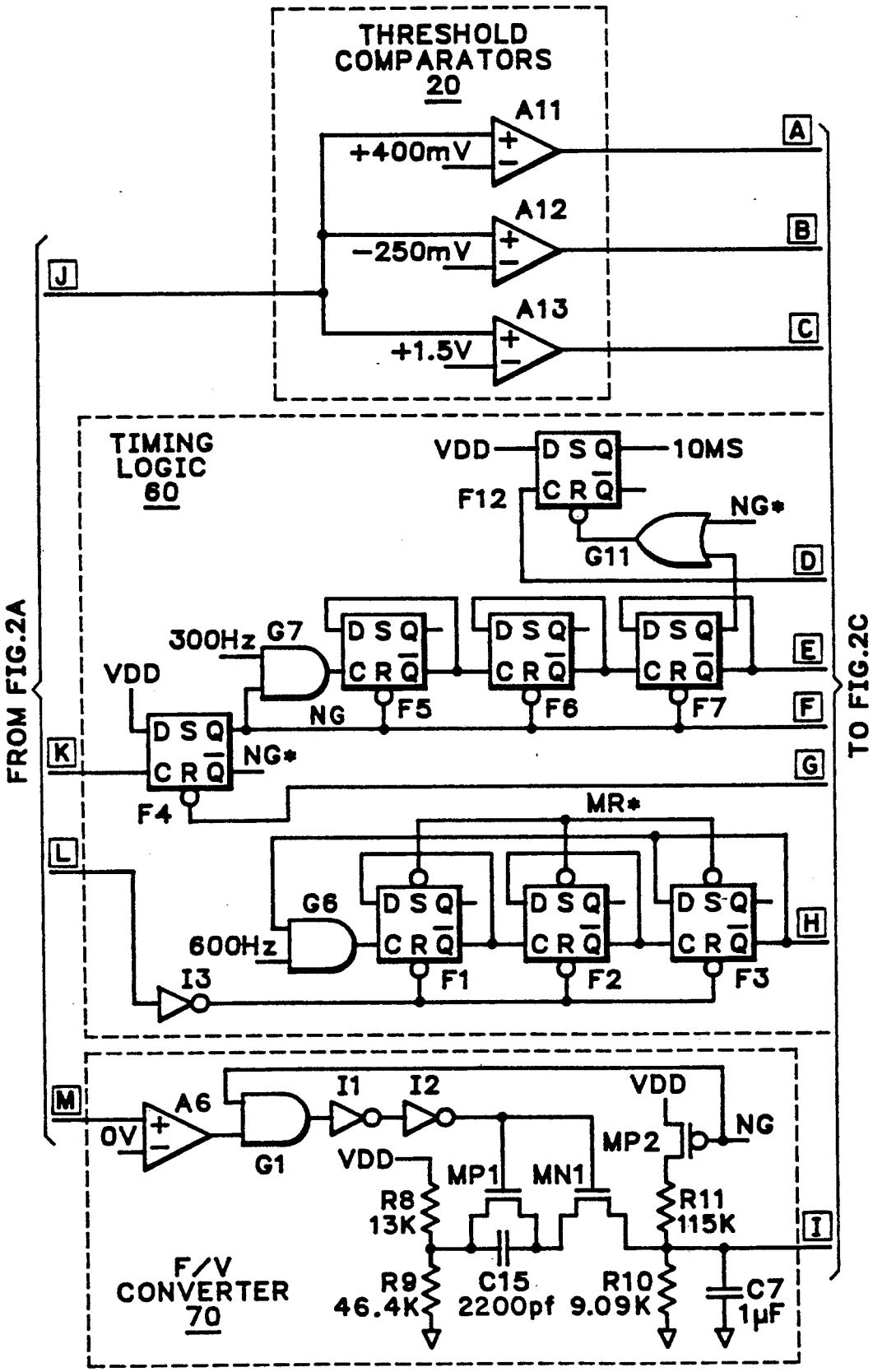
Figure 2C:
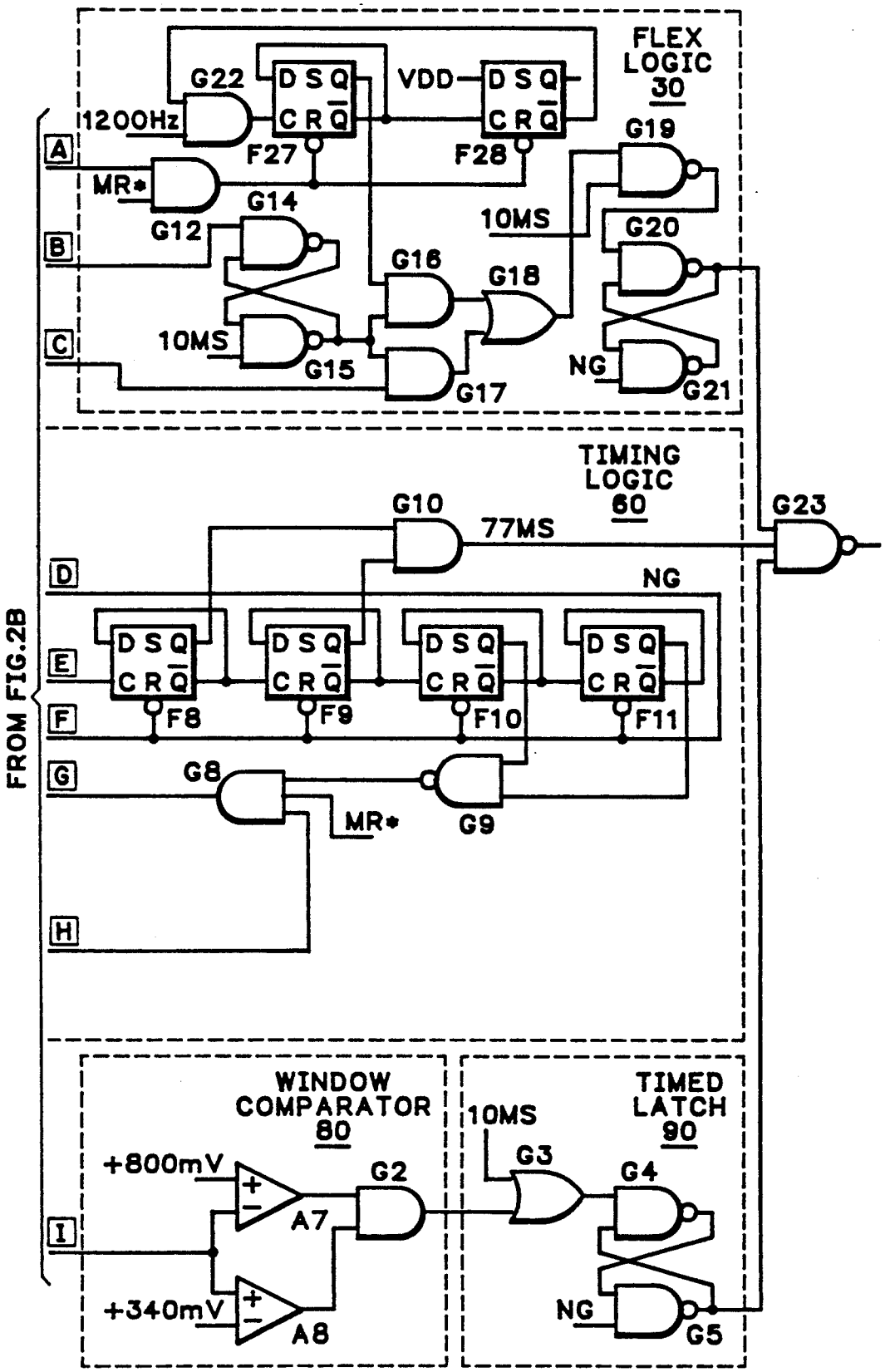

Referring to FIG. 2A the microphone X1 is an electret microphone having a frequency response from 20 Hz to 20 kHz plus or minus 3 db whose output polarity is positive for an increase in atmospheric pressure and negative for a decrease in atmospheric pressure. The microphone should be of the type that has a wide dynamic range, greater than 120 db, and an omni-directional pickup pattern. The bias current for the microphone is supplied from a 5 volt DC source through resistor R17.

The output of the microphone is coupled to a high frequency channel comprising high frequency filter 40. Although the microphone chosen for this application has a wide frequency response and active filtering is used throughout, it should be recognized that frequency shaping could be accomplished partially or even entirely in the microphone design rather than in the filter design. In order to detect the breaking of laminated window glass when the microphone is at a distance from the window, the high frequency filter 40 must have a minimum slope of 6 db per octave from 0 Hz to 5 kHz and then rise to a 12 db per octave slope by 8 kHz. Above 20 kHz the filter response is rolled off at a minimum—6 db per octave rate to attenuate undesired ultrasonic signals.

The network including capacitor C1 resistor R1, capacitor C2 resistor R2, and amplifier A1 form an active band pass filter with gain. Capacitor C1 isolates the DC signal of the microphone from the circuitry of the filter and in conjunction with resistor R1 determines a high pass pole near 19 kHz. This emphasizes high frequencies at a rate of plus 6 db per octave within the band width between 0 Hz and 19 kHz. Capacitor C2 in conjunction with resistor R2 determines a low pass pole near 24 kHz which provides a −6 db roll off per octave of ultrasonic frequencies. The network comprising capacitors C3, C4, C5 and resistors R3, R4, and R5 and amplifier A2 form a low pass filter with peaking. Capacitor C3 isolates the DC offset of the first stage from the second and in conjunction with resistor R3 determines a sufficiently low high pass pole near 16 Hz. The network in the feedback path from amplifier A2 peaks the response at 20 kHz and provides additional rise in the slope from +6 db per octave. Amplifier A3 forms an additional amplification stage with the ratio of resistor R7 to resistor R6 setting the gain and capacitor C6 isolating the DC offset of amplifier A2 from the circuitry of amplifier A3. Capacitor C6 and resistor R6 determine a sufficiently low high pass pole near 160 Hz.

The frequency to voltage converter includes an amplifier A6 that converts the output of the high frequency filter 40 from the amplitude domain to the frequency domain. The output of A6 is gated by an AND gate G1 that is triggered by the NG (noise gate) timing signal. A signal above the zero voltage threshold on the comparator amplifier A6 turns off switch MP1 and turns on switch MN1 placing an amount of charge on capacitor C7 that is determined by capacitor C15 and resistors R8 and R9 as well as the bias voltage across capacitor C7. When the signal drops below the threshold of the comparator, switch MN1 is turned off and switch MP1 is turned on, zeroing capacitor C15 and allowing the charge on capacitor C7 to leak to ground through resistor R10. The voltage developed across capacitor C7 in response to this periodic signal subtracts against the voltage to charge capacitor C15 and reduces the amount of charge delivered to capacitor C7. The output of the frequency to voltage converter is prebiased so that it lies between the two trigger points of the window comparator 80. This is done by turning on switch MP2 and connecting a voltage source VDD to the voltage divider which is formed by resistors R11 and R10 which then charges capacitor C7.

The output of the frequency to voltage converter is connected to the window comparator 80 which includes comparator amplifiers A7 and A8 which have outputs coupled to AND gate G2. The output of the frequency to voltage converter 70 is prebiased through switch MP2 to keep its output between the trigger points of +800 millivolts and +340 millivolts which are inputs to comparator amplifiers A7 and A8 respectively. Voltages that result from frequencies that lie within the band of interest will allow the output of the frequency to voltage converter 70 to stay between these trigger points. Many false alarms have average frequencies that are always below the threshold of the window comparator 80, and some false alarms start out initially below the threshold and then go above the threshold into the window. Prebiasing the output in the window makes these events invalidate the signal by driving it out of the window. This is due to the fact that all true glass breaks have average frequencies that will lie in the window except for some worst case tempered glass breaks which are initially below the bottom of the window but then climb into the window within the first 10 milliseconds.

The output of the window comparator 80 sets a timed latch 90 that includes NAND gates G4 and G5. The input to the NAND gate G4 is an OR gate G3, and the other input to the OR gate G3 is a timed 10 millisecond pulse. This pulse occurs when the system is initially triggered as will be explained below. The 10 millisecond pulse keeps the timed latch 90 from resetting during the first 10 milliseconds of an event which may be a valid glass break. This is because as explained above, some types of glass, particularly tempered glass, can break without necessarily generating frequencies during the first 10 milliseconds which would be within the limits of the window comparator 80. The 10 millisecond pulse keeps the latch 90 from resetting if the break is of this type of glass. After the initial 10 milliseconds, the output of the window comparator 80 alone will determine whether the latch 90 is reset. The latch is enabled by the timed NG (noise gate) signal whose origin will be explained below.

The output of the microphone X1 is also connected to a low frequency band pass filter 10 which consists of two amplifiers A9 and A10 together with appropriate feedback networks. The network associated with amplifier A9 includes DC blocking compacitor C9, which with resistor R13 determines a high pass pole at 3.4 Hz. Resistor R14 and capacitor C10 determine a low pass pole near 34 Hz. The second section of the filter associated with amplifier A10 includes DC blocking capacitor C11 which with resistor R15 determines a high pass pole near 3.4 Hz. R16 and capacitor C12 form a low pass pole at 154 Hz. This filter has a frequency response that emphasizes the 50 Hz to 100 Hz region, since it has been empirically determined that the initial flex made by glass just prior to its being broken is found within this frequency region. Also the positive pressure wave resulting from the initial inward flex just prior to a break is of higher magnitude than an outward flex especially for tempered glass. When tempered glass breaks, the outward flex after the initial inward flex is highly damped, thus detection schemes that are triggered by either an outward flex or by cycle counting may fail to detect many such breaks. The filter 10 is therefore configured to have an output in the low frequency region that naturally occurs in all types of glass breaks.

The output of the filter 10 is connected to a threshold comparator network 20 which includes comparators A11, A12 and A13. The comparator amplifier A11 detects pressure waves associated with objects breaking a window and its threshold is set sufficiently low to detect worst case flexes. This is because it has been determined that tempered glass, especially, generates a positive pressure wave that is much lower in amplitude than those caused by breaking plate and laminated glass. Comparator A13 detects high level pressure waves created in very small rooms or airlocks which would be detected before a window or pane actually breaks. Comparator amplifier A12 is part of an inhibit network that detects negative pressure which is not associated with glass breaking. The outputs of these three comparators are analyzed in the flex logic circuit 30.

Even though the window flexes before it breaks, the high frequencies of the break will reach their peak before the low frequency pressure wave resulting from a valid flex does and are thus easier to detect first. It has been empirically determined that a valid flex is always detectable within less than 10 milliseconds after detection of the first high frequency components of the break. Therefore, a positive transition above the threshold of comparator amplifier A11 turns on gate G12 and triggers a 1 millisecond one shot comprised of amplifier G22 and flip flops F27 and F28, the purpose of which is to indicate an immediately occurring increase in positive atmospheric pressure. Either the output of comparator A13 or A11 will set the latch comprised of NAND gates G20 and G21 unless inhibited by the latch comprised of NAND gates G14 and G15. Because of the 10 millisecond input to NAND gate G19, this event must occur, if at all, within the first 10 milliseconds of the break event. The output latch, which is comprised of NAND gates G20 and G21 is enabled by the NG signal.

In the case of an initially negative-going pressure wave occurring within the first 10 milliseconds, latch G14, G15 will be low preventing AND gates G16 or G17 from passing a valid high signal to OR gate G18. This forces the latch G20, G21 low which in turn forces the output of NAND gate G23 high, disabling the alarm.

The timing logic network 60 is triggered by a high frequency event initiated by the trigger comparator circuit 50. This circuit includes two trigger amplifiers A4 and A5. Comparator amplifier A5, which has a relatively low threshold, institutes a five millisecond retriggerable one shot comprising inverter I3, gate G6, and flip flops F1–F3 whose output resets flip flop F4 though and gate G8. Flip Flop 4 may also be reset through NAND gate G9 in addition to being reset by the five millisecond retriggerable one shot or the master reset (MR*) pulse. If the amplitude of the high frequency event is high enough, comparator amplifier A4 is triggered which clocks flip flop F4 and produces the NG (noise gate) pulse at its Q output. From the noise gate pulse a chain of flip flops F5–F11 are triggered which develop pulses st various times and having various duty cycles. A 10 millisecond timing pulse whose leading edge is substantially aligned with the NG pulse is produced by flip flop F12. This pulse is then provided as an input to NAND gates G15, G19 and OR gate G3 in the timed latch 90. The AND gate G10 produces a 77 millisecond pulse (i.e., its leading edge is initiated at 77 milliseconds) in order to enable NAND gate G23. Thus, according to the system logic, if the high frequency components of the break have not driven the output of the frequency to voltage converter 70 out of the window established by the window comparator 80 after the initial 10 milliseconds of the break, and before 77 ms after the break, and if the initial low frequency pressure wave occurred within the first 10 milliseconds of the break, a valid alarm condition will be sensed.

Figure 3:
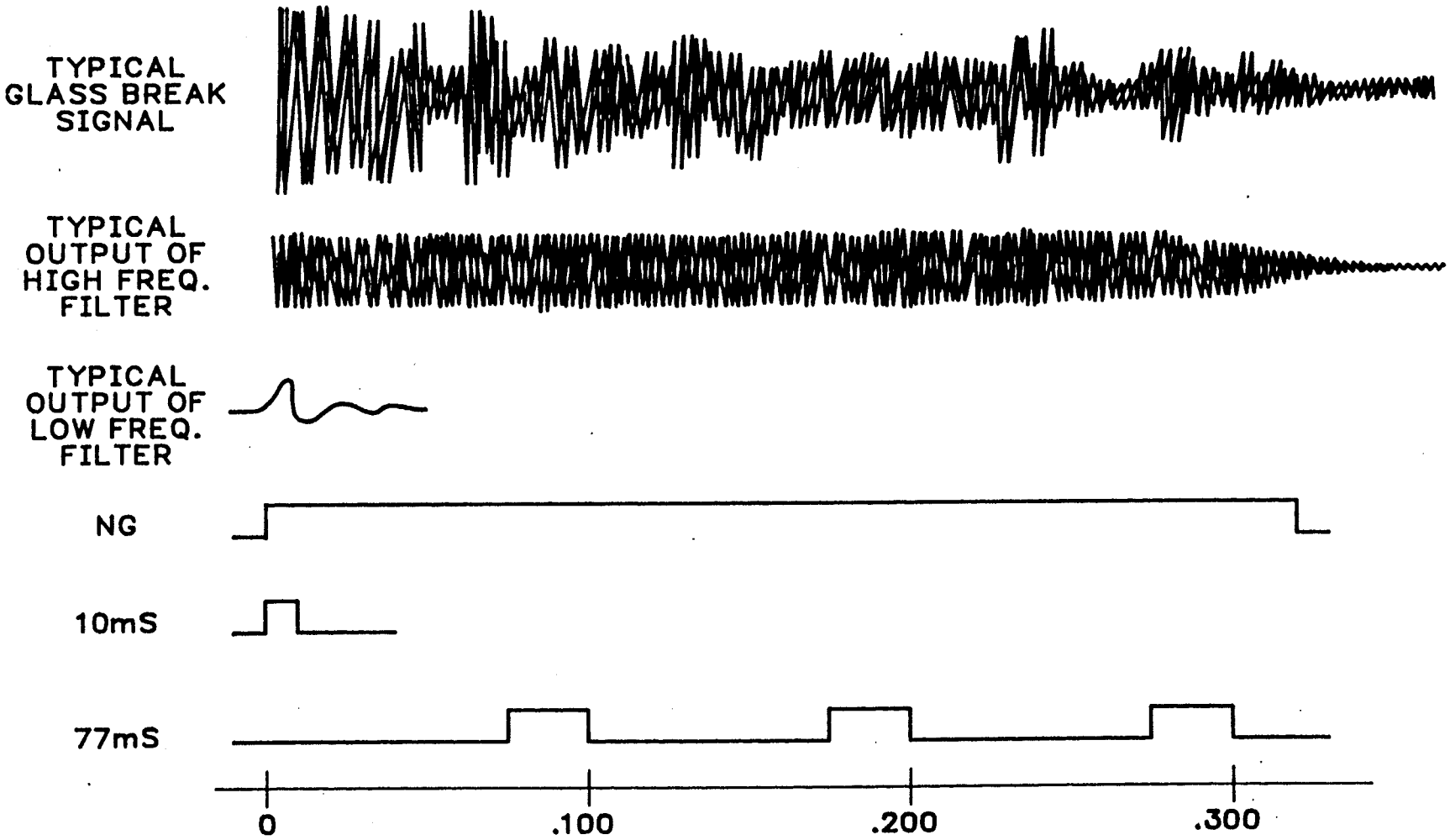
FIG. 3 is a waveform diagram illustrating the essential system timing.

FIG. 3 illustrates the essential timing of the system. A typical glass break signal generates the filter outputs shown in FIG. 3 and the NG and 10 millisecond pulse signals are generated accordingly. Because the break event is in the correct frequency range and of sufficient amplitude to trigger the timing logic in network 60, the output of the low frequency band pass filter 10 goes sufficiently high within the first 10 milliseconds to set the latch G20, G21 at the output of the low frequency channel. The time between the end of the 10 millisecond pulse and the beginning of the pulse at 77 milliseconds is a period during which the high frequency channel can be driven out of the window established in the window comparator 80 by an invalid signal. If it is not driven out of the window, however, at the initiation of the pulse at 77 milliseconds, the alarm will be triggered. The noise gate signal can be reset anytime the high frequency signal goes below its threshold for greater than 5 milliseconds.

It should be appreciated that various clock frequency signals and voltages are used herein but the circuits generating them are not shown. For example, the signal MR* is a master reset pulse generated upon power-up of the system by the power supply. These signals are produced by conventional oscillators and voltage supplies and as such their details are well known to those of ordinary skill in the art.

Various modifications to the above invention are possible without departing from the spirit of the invention. For example, the high and low frequency filters may be of different configuration from those shown and could even be incorporated in the transducer design. Also, the frequency to voltage converter and window comparator circuits have been shown with the system biased to assume a valid signal which can be forced out of the window. This gives the system a faster response and makes it easier to detect the breaking of tempered glass. The system could be configured, however, so that a valid signal must occur before an enabling signal would be provided by a latch or the like.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A glass break detector for detecting the breaking of a window or the like comprising:

(a) an acoustic transducer;

(b) a flex detection circuit responsive to the acoustic transducer for detecting a low frequency positive acoustic wave characteristic of an inward flex of the window; and (c) an alarm circuit responsive to the flex detection circuit for generating an alarm.

2. The glass break detector of claim 1, further including a high frequency bandpass filter for detecting high frequency acoustic waves characteristic of breaking glass, and a logic network for enabling said alarm circuit when said low frequency positive acoustic wave is detected by said flex detection circuit during a predetermined time window initiated by said high frequency acoustic waves.

3. The glass break detector of claim 2, further including an alarm inhibit network for detecting a low frequency negative acoustic wave and for disabling said alarm circuit if said low frequency negative acoustic wave is detected during said time window.

4. The glass break detector of claim 3, further including a signal processing network responsive to said high frequency bandpass filter for sensing acoustic waves within a preselected frequency range of said high frequency acoustic waves and for providing an alarm-enabling signal if waves having frequencies in said range are present after said predetermined time window.

5. The glass break detector of claim 4 wherein said signal processing network comprises a frequency-to-voltage converter having an output whose amplitude varies with frequency and a window comparator for providing upper and lower frequency limits for said frequency range of said high frequency acoustic waves.

6. The glass break detector of claim 5, further including an alarm timing network for activating said alarm when said high frequency acoustic waves are within the frequency limits of said window comparator at a predetermined time after said alarm circuit is enabled by said logic circuit.

7. The glass break detector of claim 5 wherein said frequency-to-voltage converter is prebiased to have an output between the upper and lower frequency limits of the window comparator.

8. The glass break detector of claim 1 wherein said acoustic transducer is an electret microphone having a wide frequency response.

9. A method of monitoring the breaking of glass incident to an intrusion, comprising the steps of:

(a) detecting the occurrence of high frequency acoustic waves characteristic of breaking glass;

(b) detecting a positive low frequency acoustic wave characteristic of an inward flex of the glass within a short time window coincident with the first occurrence of said high frequency acoustic waves; and (c) initiating an alarm after performing steps (a) and (b).

10. The method of claim 9, further including the step of detecting the occurrence of high frequency acoustic waves that lie within predetermined frequency limits for a time period after the expiration of the time window of step (b) and as a prerequisite to performing step (c).

* * * * *

US005192931B1

REEXAMINATION CERTIFICATE (3883rd)

United States Patent [19]

[11] B1 5,192,931

Smith et al.

[45] Certificate Issued Sep. 28, 1999

[54] DUAL CHANNEL GLASS BREAK DETECTOR

[75] Inventors: Richard A. Smith, Portland; Christopher A. Bernhardt, Tigard, both of Oreg.

[73] Assignee: SLC Technologies, Inc., Tualatin, Oreg.

Reexamination Request:
No. 90/005,042, Jul. 20, 1998

Reexamination Certificate for:

| | |
|---|---|
| Patent No.: | **5,192,931** |
| Issued: | **Mar. 9, 1993** |
| Appl. No.: | **07/835,733** |
| Filed: | **Feb. 11, 1992** |

[51] Int. Cl.[6] ..... G08B 13/04
[52] U.S. Cl. ..... 340/550; 340/541; 340/544
[58] Field of Search ..... 340/550, 541, 340/544

[56] References Cited

U.S. PATENT DOCUMENTS

| | | | |
|---|---|---|---|
| 4,134,109 | 1/1979 | McCormick et al. | 340/550 |
| 4,668,941 | 5/1987 | Davenport et al. | 340/550 |
| 4,928,085 | 5/1990 | DuRand, III et al. | 340/544 |
| 5,117,220 | 5/1992 | Marino et al. | 340/550 |

*Primary Examiner*—Glen R. Swann, III

[57] ABSTRACT

A glass break detector for detecting the breaking of a window or the like includes an acoustic transducer having a wide band frequency response, coupled to a dual channel filter and signal processing circuit. A low frequency channel detects an initial positive compression wave caused by the inward flex of the window and a high frequency channel detects the acoustic spectrum which is characteristic of breaking glass. The two channels are combined in a logic circuit that is timed so that the low frequency positive flex is detected initially with the high frequency component following shortly thereafter. If both timing conditions are fulfilled, an alarm is initiated. Additional circuitry is provided to inhibit the alarm if a negative compression wave is initially detected. The detection sequence is initiated by a loud sound characteristic of breaking glass.

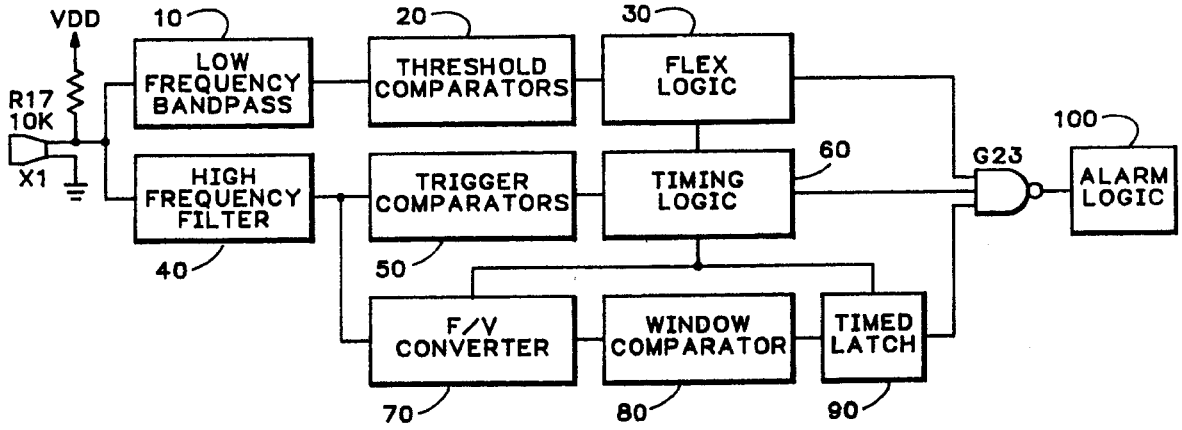

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–10 is confirmed.

New claims 11–15 are added and determined to be patentable.

*11. The glass break detector of claim 1, further including an alarm inhibit network for detecting a low frequency negative acoustic wave and for disabling said alarm circuit if said low frequency negative acoustic wave is detected during a predetermined time window.*

*12. The glass break detector of claim 2, further including a signal processing network responsive to said high frequency bandpass filter for sensing acoustic waves within a preselected frequency range of said high frequency acoustic waves and for providing an alarm-enabling signal if waves having frequencies in said range are present after said predetermined time window.*

*13. The glass break detector of claim 12 wherein said signal processing network comprises a frequency-to-voltage converter having an output whose amplitude varies with frequency and a window comparator for providing upper and lower frequency limits for said frequency range of said high frequency acoustic waves.*

*14. The glass break detector of claim 13, further including an alarm timing network for activating said alarm when said high frequency acoustic waves are within the frequency limits of said window comparator at a predetermined time after said alarm circuit is enabled by said logic circuit.*

*15. The glass break detector of claim 2 wherein said acoustic transducer is an electret microphone having a wide frequency response.*

* * * * *